United States Patent [19]

Hansen

[11] 4,035,115

[45] July 12, 1977

[54] VANE PUMP

[75] Inventor: Lowell D. Hansen, Rockford, Ill.

[73] Assignee: Sundstrand Corporation, Rockford, Ill.

[21] Appl. No.: 540,836

[22] Filed: Jan. 14, 1975

[51] Int. Cl.[2] ..... F04C 1/00; F04C 15/02

[52] U.S. Cl. ..... 418/183; 418/269

[58] Field of Search ..... 418/183, 184, 186, 268, 418/78, 82

[56] References Cited

U.S. PATENT DOCUMENTS

| | | | |
|---|---|---|---|
| 861,937 | 7/1907 | Beach et al. | 418/184 |
| 1,123,977 | 1/1915 | Baker et al. | 418/183 |
| 2,222,689 | 11/1940 | Schott | 418/184 |
| 2,743,090 | 4/1956 | Malan | 418/184 |
| 3,175,505 | 3/1965 | Soltau | 418/186 |
| 3,230,840 | 1/1966 | Hanson | 418/184 |
| 3,790,314 | 2/1974 | Swain et al. | 418/184 |
| 3,869,231 | 3/1975 | Adams | 418/268 X |

*Primary Examiner*—Carlton R. Croyle
*Assistant Examiner*—Leonard Smith
*Attorney, Agent, or Firm*—Wegner, Stellman, McCord, Wiles & Wood

[57] ABSTRACT

A vane pump having a rotor with a plurality of vanes movably carried in slots in the rotor and having their positions controlled by a cam ring surrounding the rotor and with port means for supplying fluid to the spaces between the vanes and withdrawing fluid under pressure from said spaces with additional port means coacting with a selected number of a plurality of passages in the rotor and associated one with each of the spaces between successive vanes whereby the spaces between vanes are filled in the conventional manner together with the additional filling action through the passages in the rotor.

2 Claims, 3 Drawing Figures

VANE PUMP

BACKGROUND OF THE INVENTION

This invention pertains to vane pumps and, more particularly, to such a pump wherein additional filling passages are provided in the rotor to fill the spaces between vanes whereby the spaces are filled even when the pump operates at a relatively high rotational speed.

In prior art vane pumps operating at high rotational speeds, there has been an inability to completely fill the spaces between successive vanes in the intake area. Efforts to solve this problem in the past have included the use of means, such as additional pumping mechanism, to provide high fluid inlet pressure to the fluid being supplied to said intake area. Another alternative has been to provide an opening in the cam ring surrounding the rotor and which controls the movement of the vanes. However, this has increased the contact stress between a vane tip and the surface of the cam ring. The foregoing expedients have resulted in either substantially increased costs in achieving the result or the pumps have not operated efficiently with a long useful life.

SUMMARY

A primary feature of the invention disclosed herein is to provide a vane pump with means for achieving complete filling of the spaces between successive vanes in a fluid intake area even when the pump is operating at a high speed.

More particularly, the invention disclosed herein provides for passages in the rotor associated one with each of the spaces between successive vanes and communicating with the source of fluid in the intake area whereby fluid can flow to said spaces through the rotor passages in addition to the normal flow thereto as provided by the conventional port means in a vane pump.

In the invention disclosed herein, the rotor passages each have a radially extending outlet into the associated space between vanes and which is located generally centrally of the rotor width whereby fluid is delivered centrally of the spaces between vanes while the conventional port means delivers fluid towards the ends of said spaced adjacent the side faces of the rotor.

With the passage outlets as described in the preceding paragraph, an additional benefit results because the fluid exiting the rotor passages is centrifuged or thrown out towards the cam ring surrounding the rotor which further increases the rapid filling action of the intervane spaces.

The vane pump has a rotor carrying the vanes with a cam ring surrounding the rotor for controlling the position of the vanes and with port plates positioned adjacent the side faces of the rotor and having port means for directing fluid to the spaces between the vanes in an intake area and for receiving fluid under pressure in a discharge area. The invention disclosed herein embodies the provision of an additional arcuate port disposed radially inwardly of the intervane port means in the intake area and having a longer arcuate extent whereby said additional port allows filling of several spaces between successive vanes throughout almost the entire extent of rotation of the rotor other than in the discharge area of the pump.

DESCRIPTION OF THE PREFERRED EMBODIMENT

Figure 1:
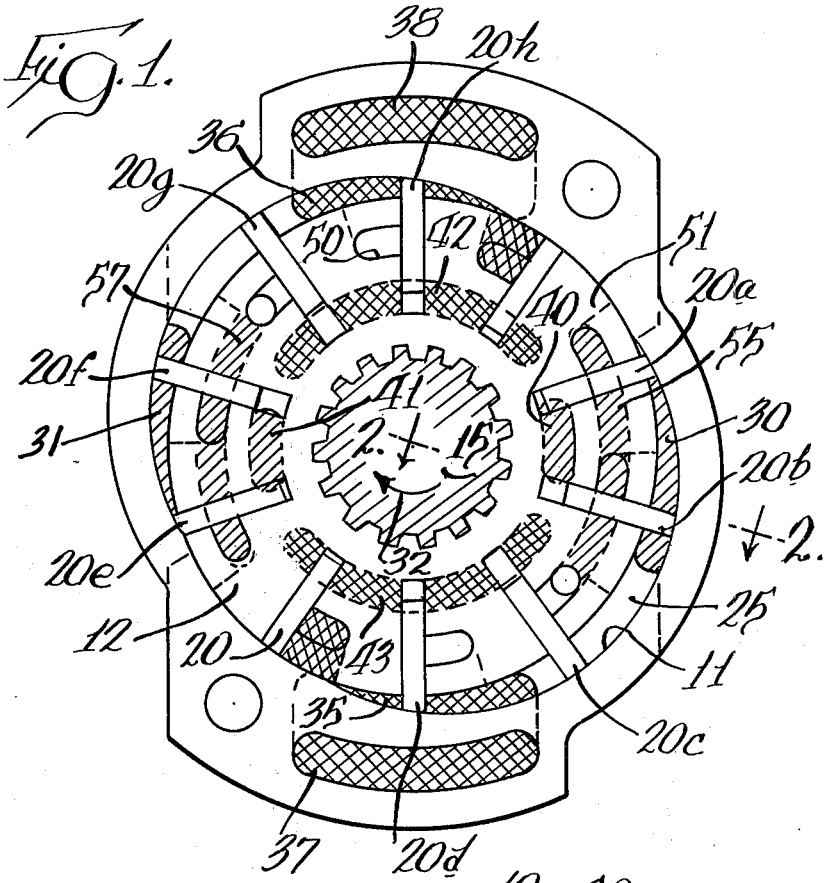
FIG. 1 is a vertical section of the vane pump taken generally along the line 1—1 in FIG. 2 and transverse to the axis of rotation of the rotor.
Figure 2:
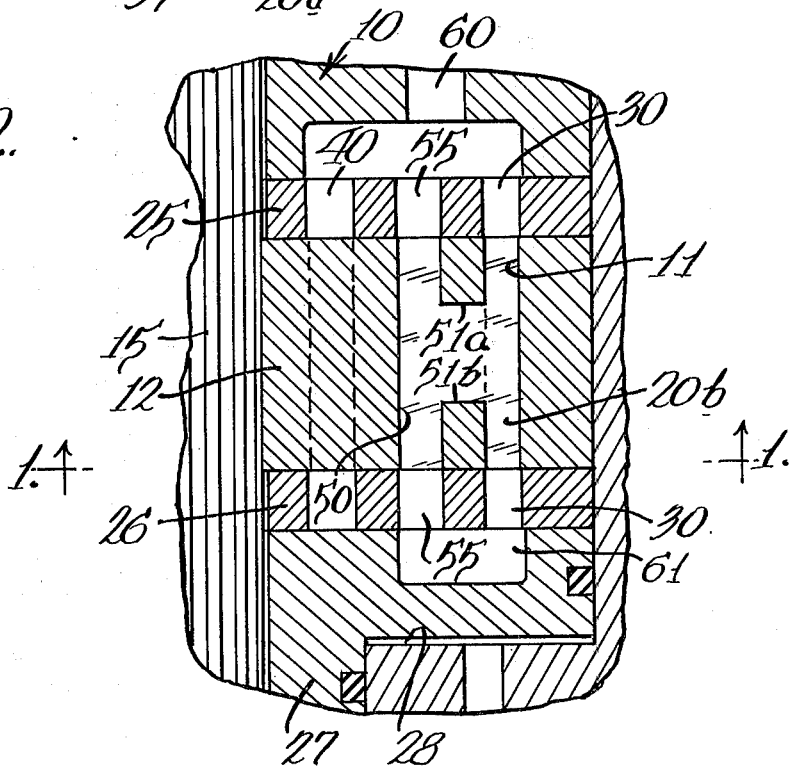
FIG. 2 is a transverse partial section, taken generally along the line 2—2 in FIG. 1.

The vane pump disclosed herein and shown particularly in FIGS. 1 and 2 has a casing 10 with an interior chamber with a cam ring 11 in which a rotor 12 is rotatably positioned and carried on a driven shaft 15. The specific vane pump disclosed herein is a double lobe unit wherein there are two pumping cycles in each revolution of the rotor 12. The rotor has a plurality of vanes 20 mounted for generally radial movement in slots formed in the rotor with the vanes **20*a* and 20*b* being in a first intake area and vanes 20*c* and 20*d* being in a first pressure discharge area. Vanes 20*e* and 20*f* are in a second fluid intake area, with vanes 20*g* and 20*h* being in a second pressure discharge area. The rotor, in addition to being surrounded by the cam ring 11, has a pair of port plates 25 and 26 positioned adjacent opposite side faces thereof with the port plate 25 abutting a part of the casing 10. The port plate 26 is urged toward the rotor 12 to urge the components together by means of a pressure loading piston 27 which is supplied with fluid under discharge pressure in a space 28.**

The port plates 25 and 26 provide port means in the two intake areas and, particularly, arcuate inlet ports 30 and 31 each of which has an arcuate extent as shown in FIG. 1 whereby intervane spaces and specifically those spaces trailing vanes **20*a* and 20*b*, for example, are exposed for filling from the inlet port with the rotor rotating in the direction of the arrow 32. The port plates 25 and 26 also have arcuate outlet port means in the pressure discharge area in the form of passages 35 and 36 which lead to outlets 37 and 38, respectively. Although not forming part of the invention disclosed herein, the vane pump has pumping chambers defined by the portions of the rotor slots at the inner ends of the vanes 20. For this purpose, the port plate 25 has a pair of relatively short inlet ports 40 and 41 in the intake areas communicating with the slots beneath the vanes for supplying fluid thereto and a pair of longer arcuate outlet ports 42 and 43 in the pressure discharge area for receiving fluid under pressure as the vanes 20 move inwardly in the slots during rotation of the rotor and under the action of the cam ring 11.** This additional pumping action by use of the slots beneath the vanes is particularly disclosed and claimed in a copending application of the assignee of this application, namely M. F. Huber and L. D. Hansen application Ser. No. 425,535, filed Dec. 17, 1973. Reference may be made thereto for a more detailed understanding of this structure.

The invention disclosed in this application relates to structure for obtaining complete filling of the spaces between the vanes in the intake area even when the pump is operating at high speed. This complete filling is obtained by increasing the total flow path for delivery of fluid to said spaces and, more specifically, by providing a flow path in addition to the arcuate inlet ports 30 and 31 in the port plates 25 and 26. The rotor 12 has a series of passages 50 extending therethrough and through the entire thickness of the rotor from one side face to the other and with there being one passage associated with each space between successive vanes. As shown in FIGS. 1 and 2, a passage 50 has one side thereof opening into a vane mounting slot and additionally the passage 50 intermediate its ends opens radially to the space between successive vanes by a recess formed in the rotor and having a back wall 51 and side walls 51*a* and 51*b*. The opposite ends of the passage 50 opening to the side faces of the rotor communicate with a first set of arcuate ports 55 in the port plates 25 and 26 in one intake area and a second set of ports 57 in the second intake area.

The inlet ports 30 and 31 which supply the spaces between successive vanes in a conventional manner as well as the additional ports 55 and 57 extending to the side faces of the rotor 12 are supplied with inlet fluid through flow passages in the body 10 of the pump. A body passage 60 is shown in FIG. 2, with the latter passage 60 also supplying the undervane inlet port 40. A chamber 61 for the port plate 26 connects with a body passage, not shown.

As seen in FIG. 1, the inlet ports 30 and 31 are arcuate and lie radially outward of the additional ports 55 and 57 and with the latter ports having a substantially greater arcuate length. All of these ports lie along circles having their centers substantially coincident with the axis of rotation of the rotor 15.

Figure 3:
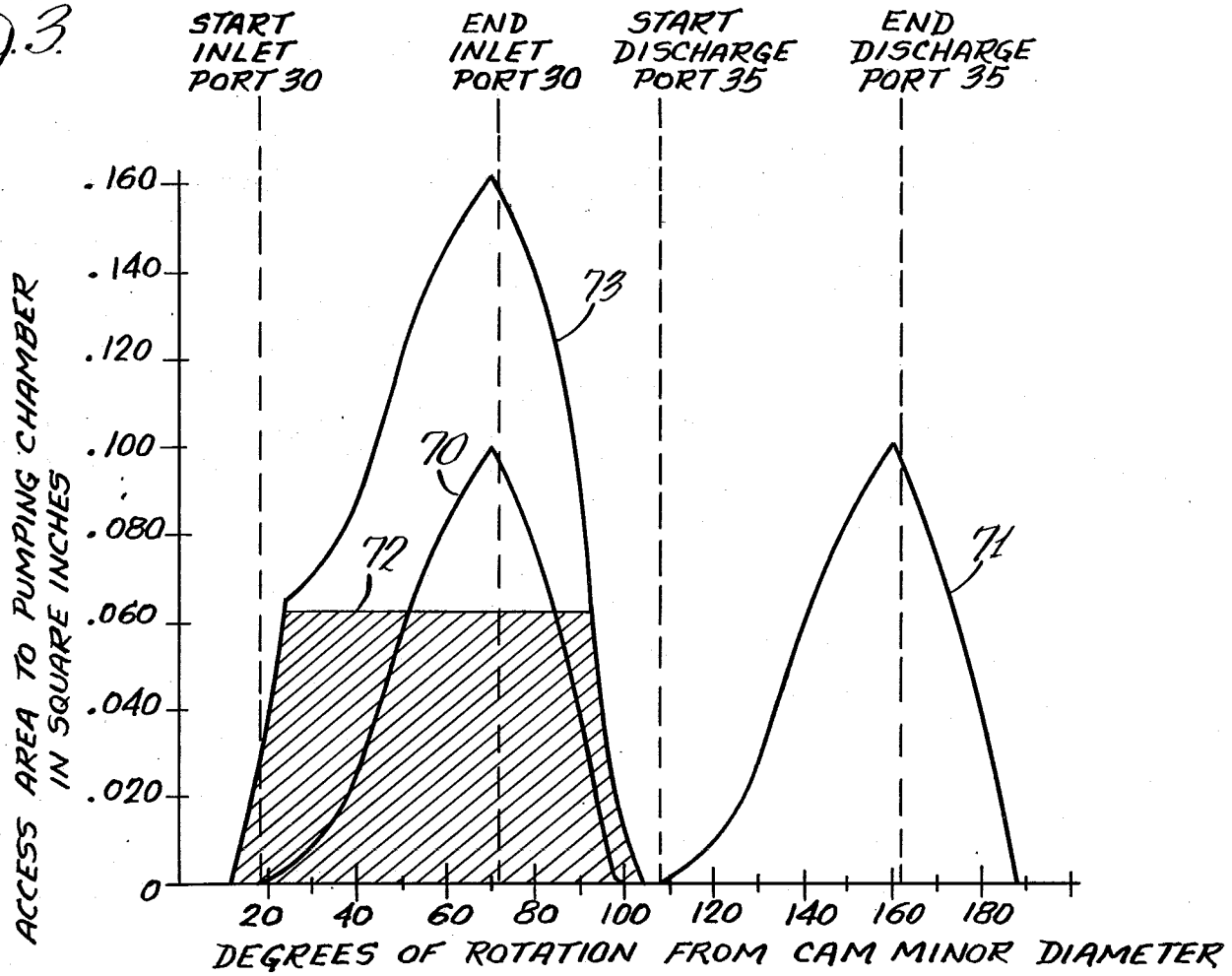
FIG. 3 is a graph illustrating the improved filling action of the vane pump structure.

The additional inlet ports 55 and 57 permit filling of an intervane space from the time in which the space initially leaves the crossover point of the pump following a pressure discharge area to the location where the space almost again reaches the pressure discharge area. Specifically, in FIG. 1, the passage 50 behind the vane 20*a* is in communication with the added port 55 slightly prior to the time that the space reaches communication with the normal inlet port 30. The space behind vane 20*c* is still in communication with both of the inlet ports 30 and 55. The communication with the port 55 terminates shortly after termination of communication with the inlet port 30. This action is illustrated in the graph of FIG. 3 wherein the lines 70 and 71 show the access area to the spaces between vanes plotted against rotation of the pump rotor and as provided by the conventional inlet port 30 and outlet port 35, respectively. The line 72 encloses the shaded access area provided by each of the additional inlet ports 55 and 57 and line 73 shows the total access area and, therefore, total flow path resulting from the combination of filling through either of the ports 30 and 31 as well as one of the added ports 55 and 57. The actual values given in the graph of FIG. 3 are for illustrative purposes, only, and not intended as limiting the invention disclosed herein.

Improved operation can be attributed to one or more of the following: the passages 50 in the pump rotor are able to communicate with the fluid inlet ports 55 and 57 in the intake area longer than the conventional filling time provided by ports 30 and 31; the passages 50 increase the access area and total flow path in which fluid may be introduced to the spaces between the vanes; the flow through the passages 50 is directed centrally to the intervane spaces while the fluid delivered through the inlet ports 30 and 31 is to the ends of said spaces; and the radial delivery from the passages 50 provides a centrifuging or outward impulse to the fluid towards the cam ring 11.

I claim:

1. A vane pump having a casing with a rotor having a plurality of slots with inner and outer ends, port plate means positioned at the sides of said rotor, a plurality of vanes movably mounted one in each of said slots, a cam ring surrounding said rotor for controlling the position of said vanes relative to the rotor and with rotation of the rotor moving the space between successive vanes first through an intake area and then through a pressure discharge area, arcuate inlet port means in the port plate means in the intake area for supplying fluid to spaces between vanes, outlet port means in the port plate means in the pressure discharge area for receiving fluid under pressure from spaces between vanes, a plurality of passages in said rotor located radially beyond the inner ends of said slots and extending between side faces of the rotor and opening outwardly thereto, there being one of said passages associated with each of said spaces between vanes and with a passage having a radial opening to said space centrally of the rotor width, and additional arcuate port means in the port plate means in the intake area exposed to said rotor side faces and in alignment with said passages and having a length greater than the first arcuate port means to provide a port section located angularly in advance of the inlet port means and opening to successive ones of said passages for additional flow access area to a space between vanes in advance of flow to a space between vanes from the inlet port means and without communication with the inner ends of said slots to increase the time for filling of a space while in said intake area.

2. A vane-type hydraulic pump having a casing with a rotor having a plurality of slots having inner and outer ends, a pair of port plates positioned one to each side of said rotor, a plurality of vanes movably mounted one in each of said slots, a double lobe cam ring surrounding said rotor for controlling the position of said vanes relative to said rotor and with rotation of the rotor moving the space between successive vanes successively through first and second intake areas and first and second pressure discharge areas which are separated by crossover points, inlet port means in at least one port plate in the intake areas for supplying hydraulic fluid to spaces between vanes, outlet ports in at least one port plate in each of the pressure discharge areas for receiving fluid under pressure from the spaces between the vanes, a plurality of passages extending through the width of said rotor and each having a side of the passage opening to a rotor slot at the trailing side of a vane and an opening to the space between successive vanes and with opposite ends of the passage opening to the side faces of the rotor at a radial location approximately midway between the inner and outer ends of a rotor slot, and additional port means in the intake areas and in alignment with the passage ends at the side faces of the rotor and having a port section positioned angularly in advance of said inlet port means and communicating with the passage ends of successive ones of said passages for delivery of fluid to an intervane space still sealed by the crossover point and prior to said last-mentioned intervane space coming into communication with said inlet port means to increase the total time available for filling said space by flow through said passages without flow through the inner ends of said slots.

* * * * *